US005886279A

United States Patent [19]

Inaba

[11] Patent Number: 5,886,279

[45] Date of Patent: Mar. 23, 1999

[54] SWITCH MECHANISM OF PIANO WITH BUILT-IN ELECTRONIC MUSICAL INSTRUMENT

[75] Inventor: Tatsuya Inaba, Hamamatsu, Japan

[73] Assignee: Kabushiki Kaisha Kawai Gakki Seisakusho, Hamamatsu, Japan

[21] Appl. No.: 836,355

[22] PCT Filed: Mar. 29, 1995

[86] PCT No.: PCT/JP95/00607

§ 371 Date: May 13, 1997

§ 102(e) Date: May 13, 1997

[87] PCT Pub. No.: WO96/30892

PCT Pub. Date: Oct. 3, 1996

[51] Int. Cl.[6] ..... G10H 1/32

[52] U.S. Cl. ..... 84/721; 84/615; 84/653; 84/DIG. 25

[58] Field of Search ..... 84/721, 746, 615, 84/653, DIG. 25

[56] References Cited

FOREIGN PATENT DOCUMENTS 56-113384 9/1981 Japan .
63-216099 9/1988 Japan .
5-29091 4/1993 Japan .
5-94185 4/1993 Japan .
6-59667 3/1994 Japan .
7-064540 3/1995 Japan .

*Primary Examiner*—William M. Shoop, Jr.
*Assistant Examiner*—Jeffrey W. Donels
*Attorney, Agent, or Firm*—David and Bujold

[57] ABSTRACT

A switch mechanism of a piano with a built-in electronic musical instrument, which eliminates the disposition of switches on the surface of a piano to improve the appearance of the piano. An upright piano(1) includes a hammering mechanism(7) which strikes strings in accordance with the operation of a keyboard(3), and thus it serves as an acoustic piano as well as an electronic piano because it has a built-in electronic sound source(9) controlled by the operation of the same keyboard(3). This upright piano(1) includes an inhibition mechanism(13) for inactivating the hammering mechanism(7) in electronic mode, a pedal mechanism(17) having a muffler pedal(16), a control portion(19) driven by a power supply(18) for controlling the electronic sound source in accordance with the operation of the keyboard(3) to produce sounds, and a power supply switch(21) turned ON/OFF by the actuation of the muffler pedal(16) to make and break the electrical connection between the power supply(18) and the control portion(19).

8 Claims, 9 Drawing Sheets

Figure 1:
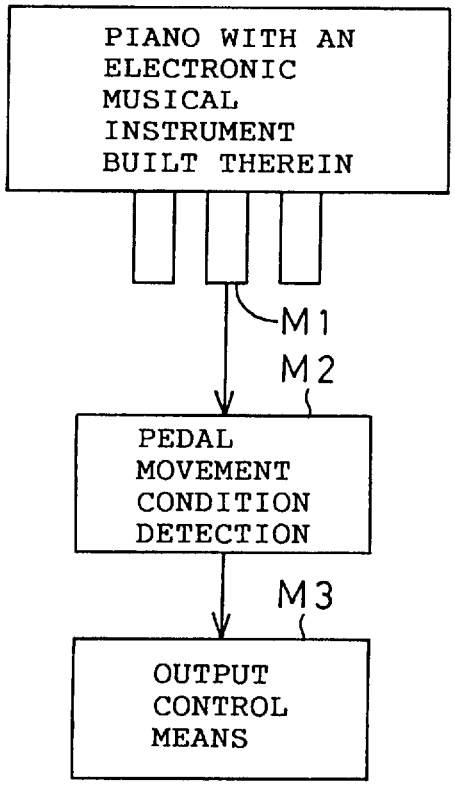

1
14
16
17
15
21
19
53
CPU
55
ROM
56
RAM
57
INPUT OUTPUT INTERFACE
9
SOUND SOURCE
10
33, 35
KEY SENSOR
POWER SUPPLY
18
HEADPHONE TERMINAL
11
LOUDSPEAKER TERMINAL
12
KEY
5
KEYBOARD
3
HAMMERING MECHANISM
7
INHIBITION MECHANISM
13

SWITCH MECHANISM OF PIANO WITH BUILT-IN ELECTRONIC MUSICAL INSTRUMENT

TECHNICAL FIELD

The invention relates to a switch mechanism of a piano with a built-in electronic musical instrument, provided with a mechanism for controlling electronic sound source in addition to a string striking mechanism.

BACKGROUND ART

Conventionally, a piano with an electronic mechanism built therein is proposed, in which an acoustic piano is combined with an electronic sound source for providing an acoustic musical performance and a musical performance from an electronic sound source (refer to the patent application laid-open No. 63-216099, and the patent application No. 5-214411 by the applicant of this application). In such piano, during the electronic sounding, musical sound produced by striking strings (referred to as string striking sound hereinafter) can be stopped by various inhibition mechanisms (sound stop means). While string striking sound is stopped, a player can play the piano listening sound from the electronic sound source via a headphone. Therefore, the player can practice the piano without being heard outside in the night time, and various other advantages can be expected.

Since the aforementioned piano is provided with various electronic circuits (for example, a control circuit for controlling the electronic sound source), power switches for electrically connecting and disconnecting the electronic circuits and a power supply need to be disposed on a predetermined position of the piano. Like the other conventional electronic pianos, the power switches are mounted on the surface of the piano by making a hole in the covering material of the piano.

The visible power switches on the surface distinguish the piano from an acoustic piano, and impair the appearance of the piano. Furthermore, the making of holes in the surface of the piano is an additional manufacture process step.

To control electronic sound, the piano with the built-in electronic musical instrument needs to have a volume switch for adjusting sound volume during the musical performance, and can be provided with a tone switch for changing tone.

When a known slide switch or other volume switch, and a tact switch or other tone switch are provided on the surface of the piano, a process step of making a hole in the surface is added to the manufacture process. Additionally, as aforementioned, these visible switches impair the appearance of the piano.

DISCLOSURE OF THE INVENTION

An object of the invention developed for solving the problem is to provide a piano with an electronic musical instrument built therein and a switch mechanism, which obviates the necessity of holes made in the surface of the piano for providing switches on the surface and does not impair the appearance of the piano.

To attain the aforementioned object, the invention recited in claim 1 provides a piano having

- a hammering mechanism for striking a string in response to operation of a keyboard,
- a pedal for controlling string striking sound produced by the hammering mechanism,

- an electronic musical instrument provided with an electronic sound source controlled according to the operation of the keyboard, and
- an inhibition mechanism for inhibiting the hammering mechanism from producing the string striking sound during the performance of the electronic musical instrument.

The piano with the electronic musical instrument build therein is characterized by a change switch for changing the operation condition of the electronic musical instrument in response to operation of the pedal.

The invention recited in claim 2 provides a piano having

- a hammering mechanism for striking a string in response to operation of a keyboard,
- a pedal for controlling string striking sound produced by the hammering mechanism,
- a controller driven electrically by a power supply for controlling an electronic sound source in response to the operation of the keyboard, and
- an inhibition mechanism for inhibiting the hammering mechanism from producing the string striking sound during the performance of the electronic sound source controlled by the controller.

The switch mechanism of the piano is characterized by a power switch for electrically connecting and disconnecting the controller and the power supply in response to operation of the pedal.

The invention recited in claim 3 provides

- the piano according to claim 2 characterized in that an indentation is formed in the side of an opening for passing through the pedal in a front base, and the pedal is stepped on and slid toward the indentation such that the controller and the power supply are electrically connected and disconnected.

For the pedal, a loud pedal, a soft pedal, a muffler pedal (mainly provided on an upright piano), a sostenuto pedal (mainly provided on a grand piano) and other are available.

In the invention recited in claim 4 an electronic musical instrument having an electronic sound source is built in an acoustic piano, and a keyboard is for common use in the musical performance. The piano with a built-in electronic musical instrument is, as shown in FIG. 1, provided with

- a pedal movement detector M2 for detecting the movement condition of a pedal M1 during the musical performance of the electronic musical instrument, and
- an output controller M3 for adjusting the condition of the output of the electronic musical instrument according to the condition of movement of the pedal M1 detected by the pedal movement condition detector M2.

In the invention recited in claim 5, an electronic musical instrument having an electronic sound source is built in an acoustic piano, and a keyboard is for common use in the musical performance.

The piano with a built-in electronic musical instrument is provided with a set mode for each object to be controlled such that the output condition of various objects to be controlled of the electronic musical instrument is set, and with a mode changeover means as a pedal function for changing over each set mode during the performance of the electronic musical instrument.

In the invention recited in claim 6, the piano with the electronic musical instrument built therein is characterized by the provision of an output condition set means as another pedal function for setting the output condition of the object to be controlled in the specified mode set by the mode changeover means recited in claim 5.

According to the invention recited in claim 1 the hammering mechanism for striking the string in response to operation of the keyboard and the pedal for controlling the string striking sound of the hammering mechanism can provide the musical performance of an acoustic piano. Furthermore, the electronic musical instrument having the electronic sound source controlled in response to operation of the keyboard can provide the musical performance of an electronic piano, because the inhibition mechanism inhibits the hammering mechanism from producing sounds during the performance of the electronic musical instrument.

In the piano according to claim 1, the operation of the electronic musical instrument can be changed over in response to operation of the pedal. Therefore, the disposition of the switches on the surface of the piano is eliminated and the appearance of the piano is not impaired.

In the piano according to claim 2, the power switch for electrically connecting and disconnecting the power supply and the controller for controlling the electronic sound source is associated with the pedal mechanism. By operating the pedal in a specified manner, for example, stepping on or shifting to the side the pedal, the power supply can be turned on and off (the controller and the power supply are electrically connected and disconnected). Therefore, no power switch is necessary on the surface of the piano and the appearance of the piano is not impaired.

In the invention according to claim 3, the indentation is formed in the side of the opening for passing through the pedal in the front base. By stepping on the pedal toward the indentation (moving the pedal down to the side), the power supply is turned on and off. Therefore, by rather simple operation of the pedal, the power supply can be turned on and off. Furthermore, when the original effect of the pedal (the effect of the player's adjustment) can be obtained by stepping on the pedal during the musical performance, the power supply is not turned on or off until the pedal is placed in the indentation. Therefore, the musical performance is not interrupted by the turning on or off of the power supply.

In the invention according to claim 4, during the performance of the electronic musical instrument built in the piano, the condition of movement of the pedal M1 is detected by the pedal movement condition detection means M2, and the output condition of the object to be controlled of the electronic musical instrument is adjusted by the output control means M3. Therefore, by stepping on the specified pedal during the performance of the electronic musical instrument, sound volume or other can be adjusted.

According to the invention as in claim 5, in the piano with the electronic instrument built therein, the set mode of each output to be controlled is provided for setting the output condition of the various objects to be controlled of the electronic musical instrument. During the performance of the electronic musical instrument, the set mode can be changed over to sound volume set mode, tone set mode and other various modes by the pedal having the mode changeover means.

According to the invention of claim 6 when the specified mode is set by the mode changeover function of the pedal recited in claim 5, the output condition of the object to be controlled in the set mode such as volume, tone and other can be set by the pedal having the output condition set means.

BRIEF EXPLANATION OF THE DRAWING FIGURES

Figure 2:
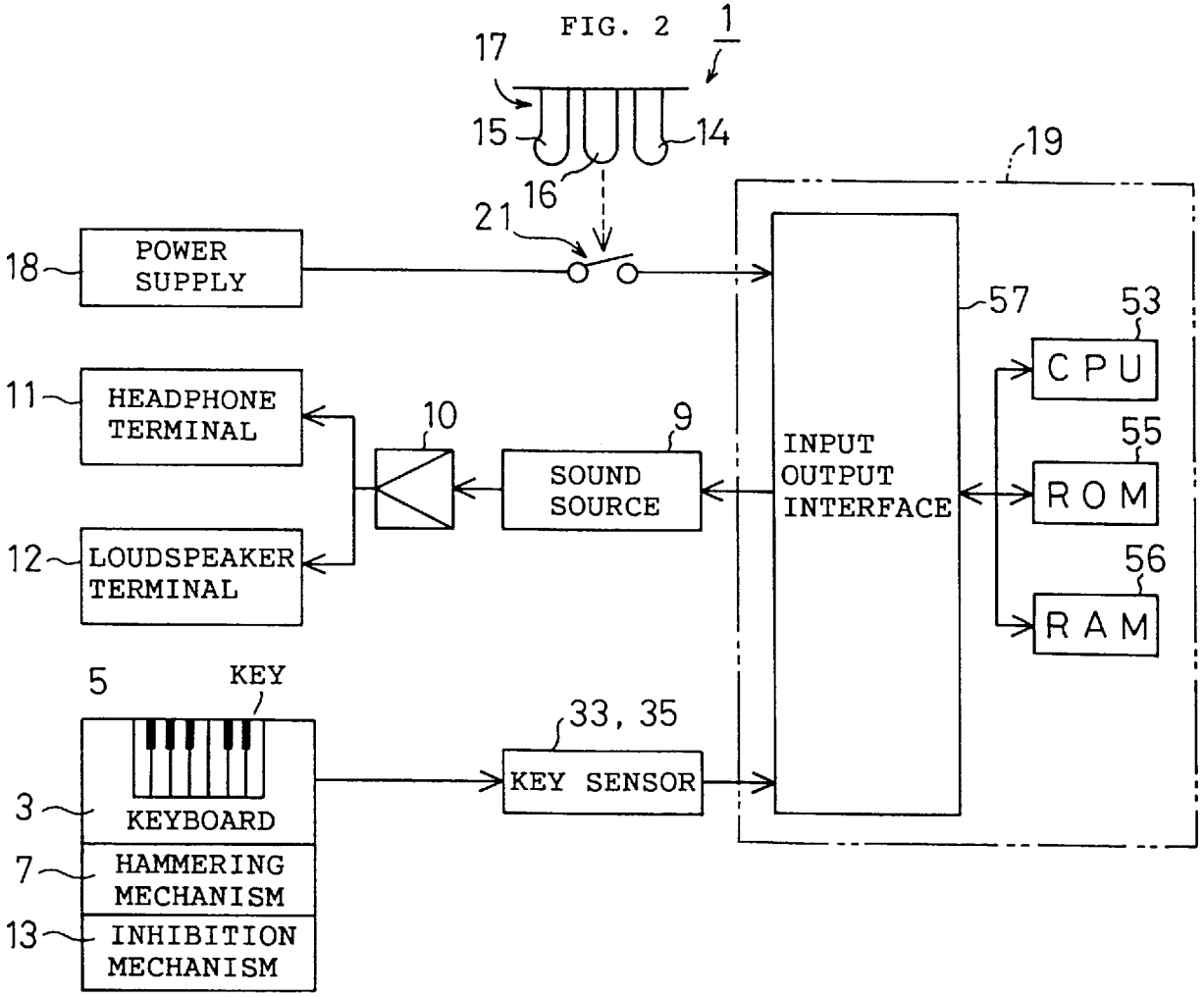
Figure 3:
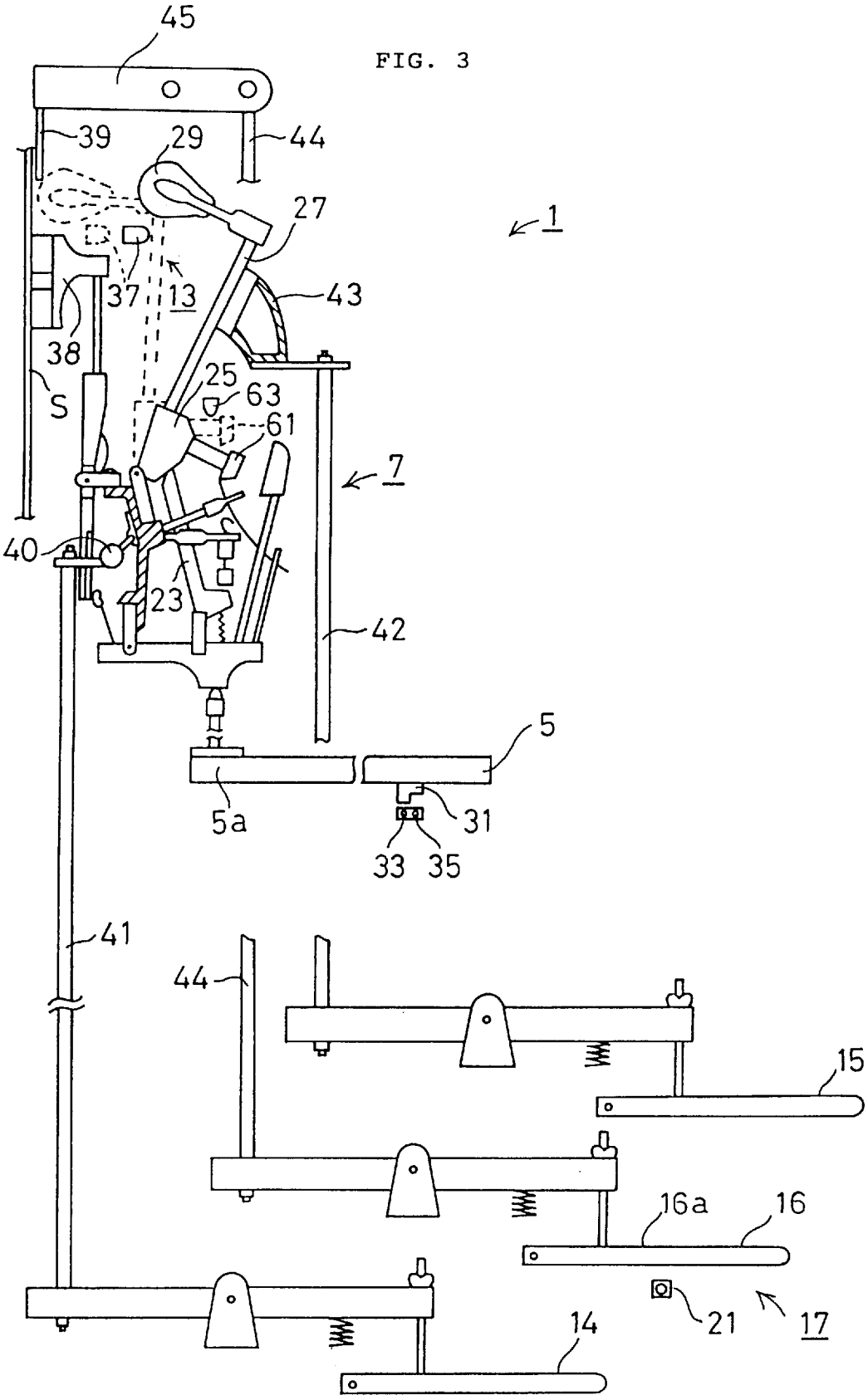
Figure 4:
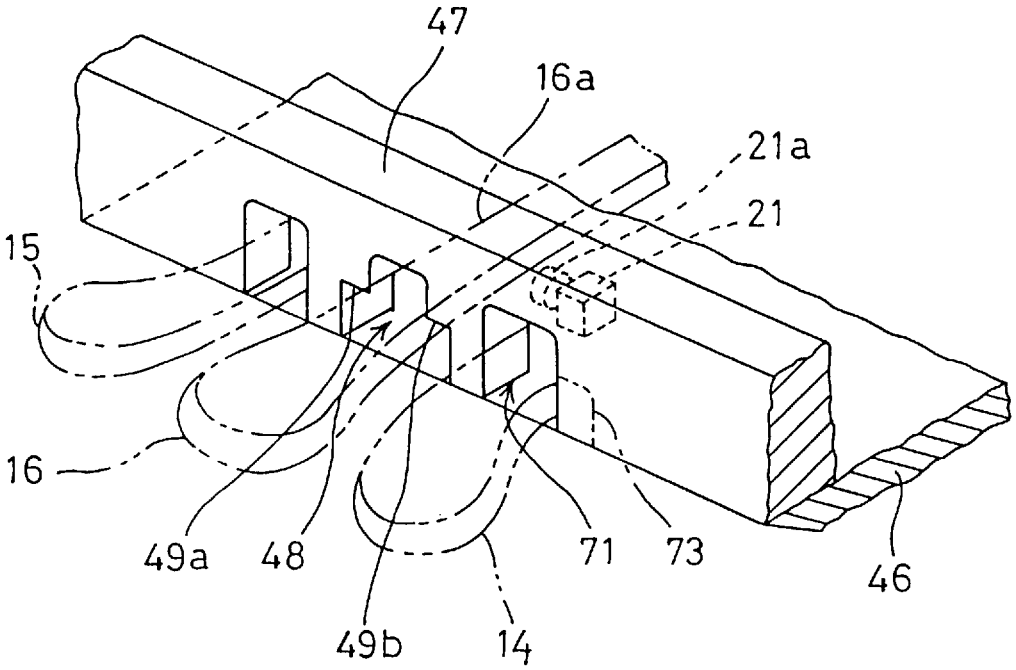
Figure 5A:
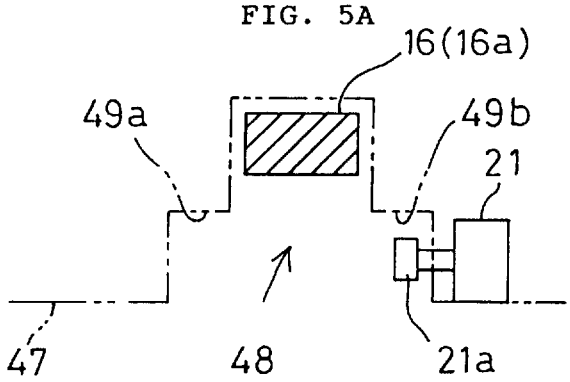
Figure 5B:
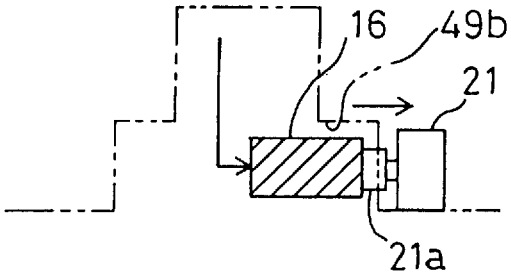
Figure 5C:
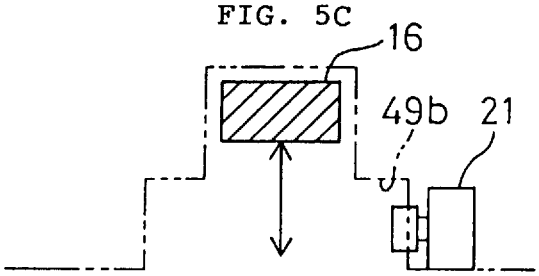
Figure 5D:
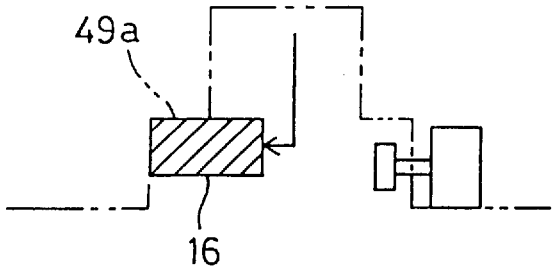
Figure 6:
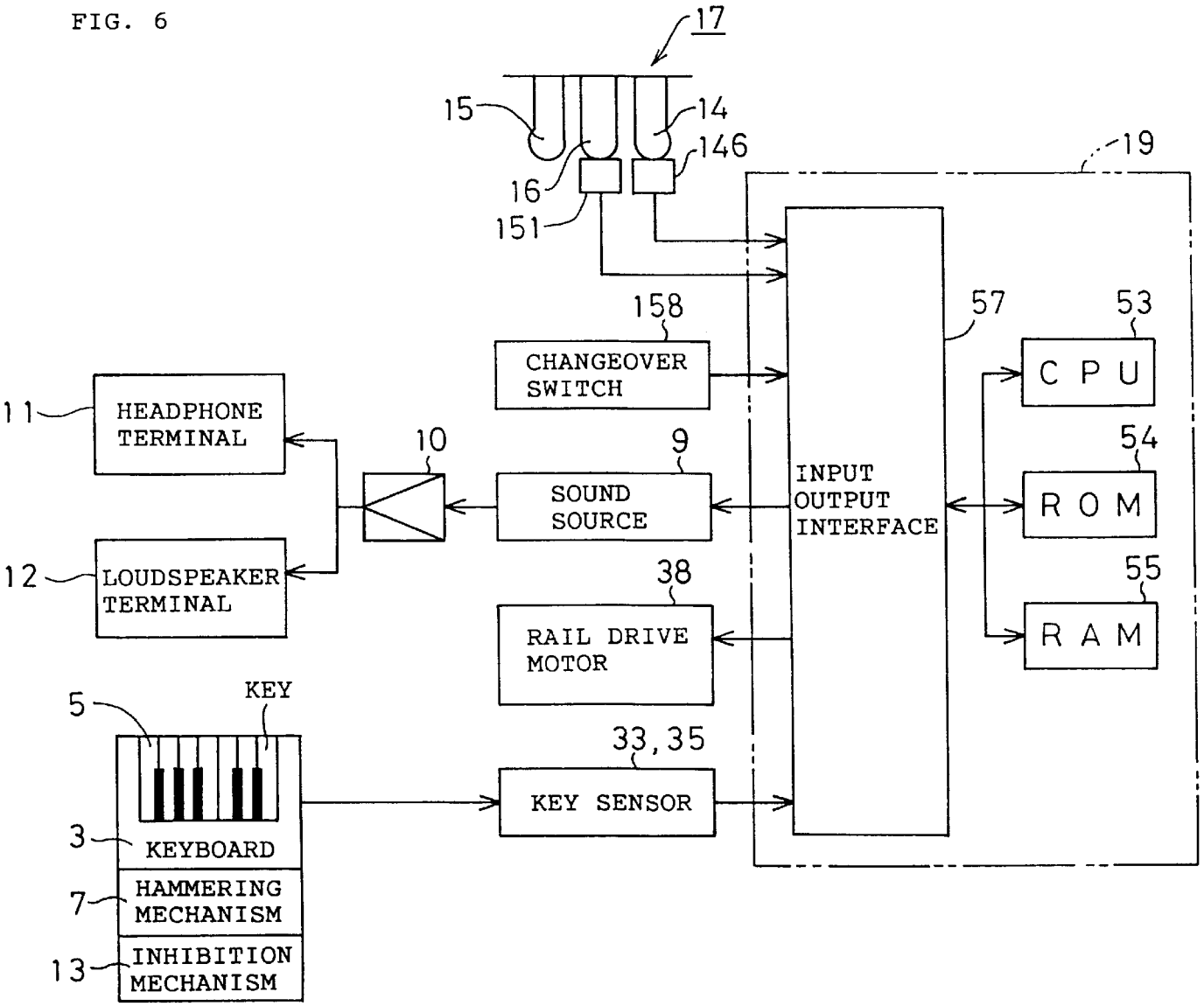
Figure 7:
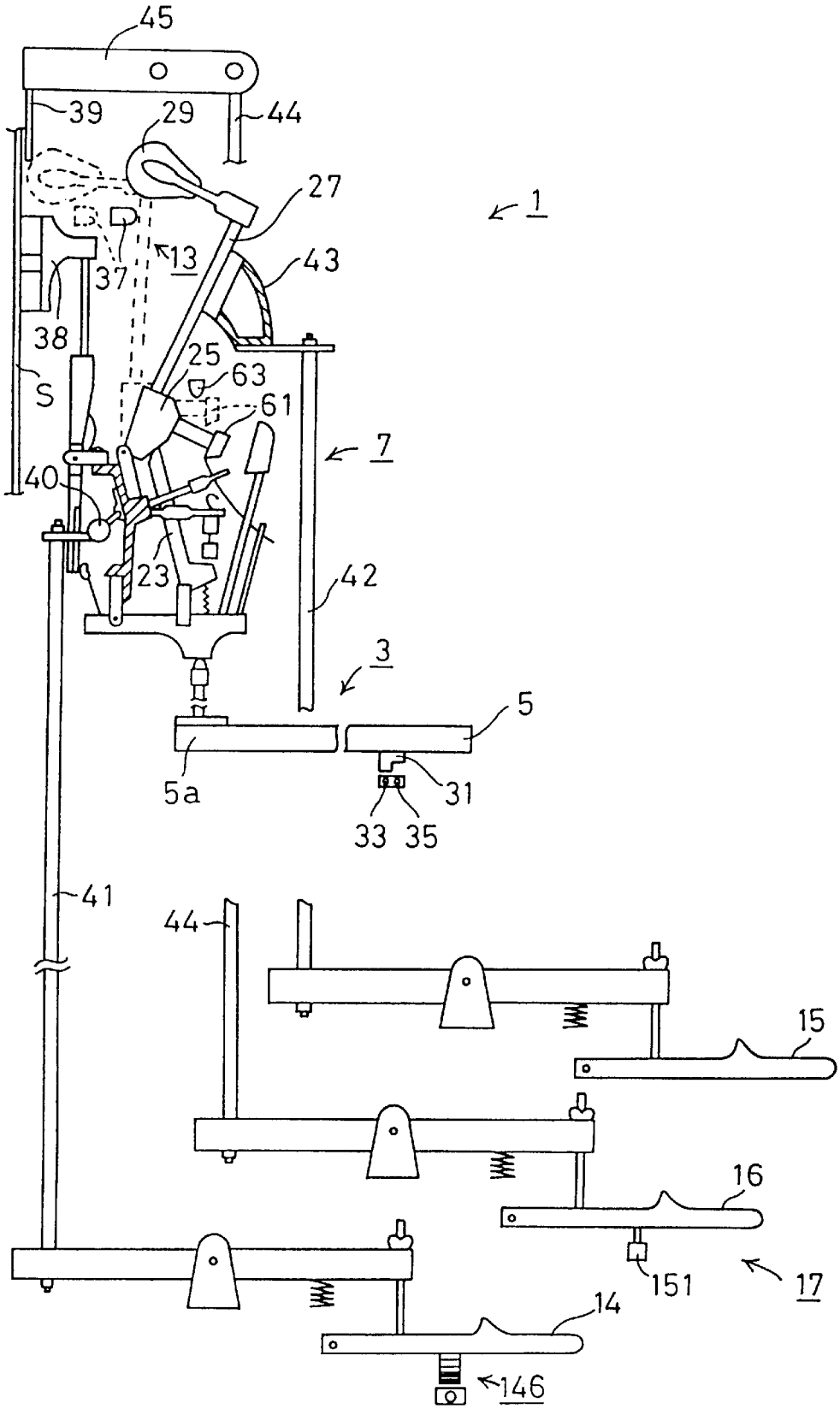
Figure 8A:
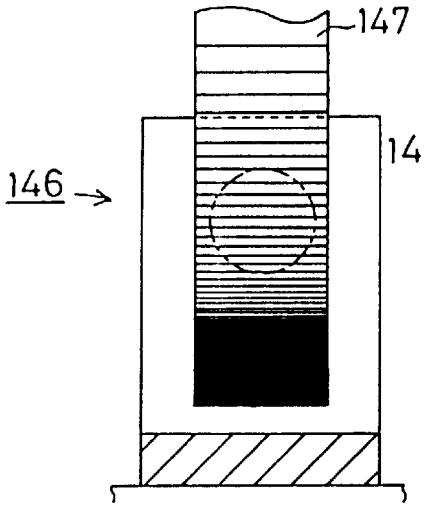
Figure 8B:
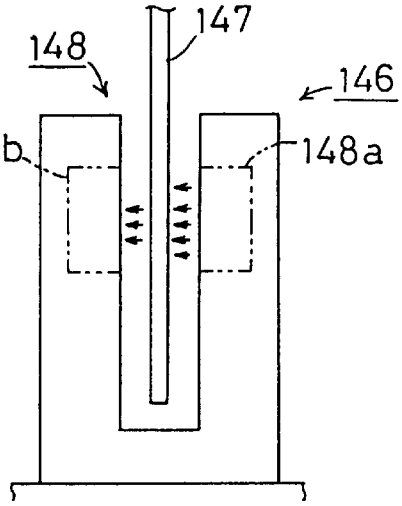
Figure 8C:
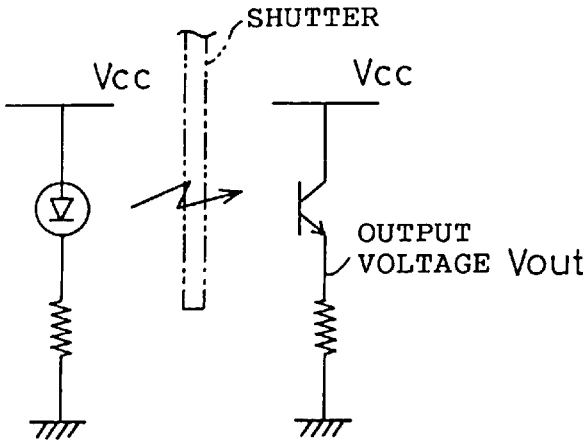
Figure 8D:
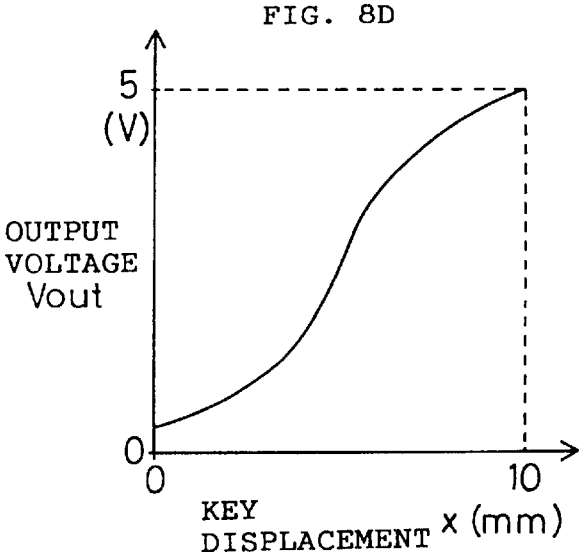
Figure 9:
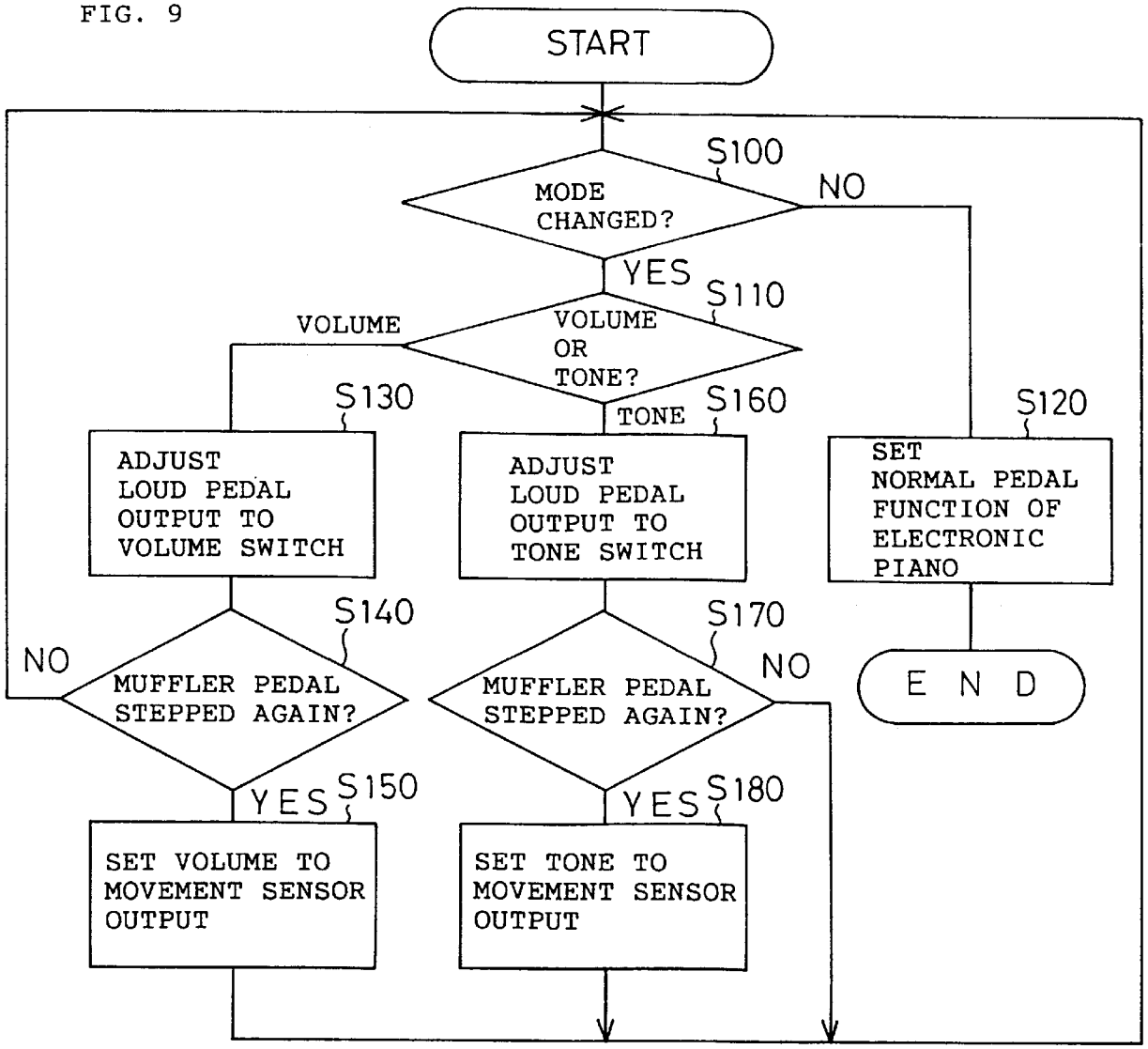

FIG. 1 is a diagrammatic representation showing the structure of the present invention, FIG. 2 is a block diagram diagrammatically showing the structure of an upright piano according to a first embodiment, FIG. 3 is an explanatory view showing a hammering mechanism and other of the upright piano of the first embodiment, FIG. 4 is a perspective view showing a pedal and a power switch in the first embodiment, FIG. 5 is an explanatory view showing a method of operating a muffler pedal and the power switch in the first embodiment, FIG. 6 is a block diagram showing an electric structure of an upright piano according to a second embodiment, FIG. 7 is an explanatory view showing a mechanical structure of the upright piano of the second embodiment, FIG. 8 is an explanatory view showing a movement quantity sensor of the second embodiment, and FIG. 9 is a flowchart showing a control process in the second embodiment.

BEST MODE FOR PRACTICING THE INVENTION

The first embodiment of the present invention is now explained based on the drawing figures.

As shown in FIG. 2, an upright piano 1 of the embodiment is, like an acoustic piano, composed of a hammering mechanism 7 for striking a string in response to operation of a key 5 on a keyboard 3, providing acoustic musical performance, and is, as an electronic piano, provided with a built-in electronic sound source 9 controlled in response to operation of the same keyboard 3, emanating electronic sound from a loudspeaker and a headphone (not shown).

In addition to the hammering mechanism 7 and the electronic sound source 9, an amplifier 10 connected to the electronic sound source 9, a headphone terminal 11 and a loudspeaker terminal 12 are provided on the upright piano 1. Furthermore, provided are an inhibition mechanism 13 for inhibiting the sounding of the hammering mechanism 7 during the performance of the electronic sound source 9, a pedal mechanism 17 composed of a loud pedal 14, a soft pedal 15 and a muffler pedal 16, and a control portion 19 electrically driven by a power supply 18 for controlling the electronic sound source 9 in response to operation of the keyboard 3 and producing sound. A power switch 21 is also provided. By operating the muffler pedal 16, the power switch 21 is turned on or off (opened or closed), electrically connecting or disconnecting the power supply 18 and the control portion 19.

Each structural element is now explained in detail.

The hammering mechanism 7 is, as shown in FIG. 3, similar to the equivalent of a conventional upright piano. In the hammering mechanism 7 when a player depresses the key 5 on the keyboard 3, a rear portion 5*a* is pushed upwards, allowing a jack 23 to push up a butt 25, and a hammer shank 27 is rotated approaching a string S. After the jack 23 further rises, the butt 25 leaves the jack 23 and the hammer shank 27 starts inertial movement (rotary movement). Finally, a hammer 29 attached to the tip of the hammer shank 27 strikes the string S. A stepped shutter 31 and key sensors 33 and 35 are provided on the underside of the front portion of the key 5 for detecting the depression and release of the key 5. The structure and operation of the hammering mechanism 7 are disclosed in detail in the patent application No. 5-214411 by the applicant of this application.

As shown in FIG. 3, the inhibition mechanism 13 has a rail 37 disposed between the hammer shank 27 and the string S. The rail 37 is a longitudinal member extending between left and right sides of the piano 1 (perpendicularly to the surface of FIG. 3), and is movable between the position shown by a solid line in the figure (operation inhibition position) and the position shown by a dotted line operation permission position) driven by a rail drive motor (not shown). Therefore, when the hammering mechanism 7 is inhibited by the inhibition mechanism 13 from producing string striking sound (during sound is produced from the electronic sound source 9), the rail 37 is secured at the operation inhibition position and the inertially rotating hammer shank 27 contacts the rail 37 at the position shown by the dotted line in the figure. As a result, the hammer 29 is inhibited from striking a string and producing string striking sound. The structure and operation of the inhibition mechanism 13 are disclosed in detail in the patent application No. 5-214411.

The pedal mechanism 17 is, as shown in FIGS. 3 and 4, composed of a loud pedal (right pedal) 14 for reverberating sound by releasing a damper 38 from the string S, a soft pedal (left pedal) 15 for softening string striking sound by moving the entire hammer 29 close to the string S, and a muffler pedal (middle pedal) 16 for reducing sound volume by lowering a felt 39 between the hammer 29 and the string S. The loud pedal 14 pushes up and allows a push rod 41 to rotate the damper 38 via a damper rod 40 and other, the soft pedal 15 pushes up and allows a push rod 42 to rotate a hammer rail 43, and the muffler pedal 16 pushes up and allows a push rod 44 to rotate the felt 39 via a support member 45.

As shown in FIG. 4 and FIGS. 5A–5D, the aforementioned power switch 21 is disposed at the right lower side of a middle portion 16*a* of the muffler pedal 16. The power switch 21 is a push switch turned on or off when a tip member 21*a* is depressed, and secured on a bottom plate 46 placed under the pedals 14–16. A left indentation 49*a* and a right indentation 49*b* are formed in the opposite sides of an opening 48 in a front base 47, through which the muffler pedal 16 is inserted. As shown in FIGS. 5A and 5B, when the muffler pedal 16 is stepped on and slid to the right indentation 49*b*, the tip member 21*a* of the power switch 21 is depressed by the muffler pedal 16.

In the same manner as a conventional electronic piano, the aforementioned loud pedal 14, the soft pedal 15 and the muffler pedal 16 are provided with a pedal sensor (not shown) for detecting the stepping on of the pedal. Even during the performance of the electronic sound source 9, the pedal effect as that of an acoustic piano can be obtained (in this case, the muffler pedal 16 serves as a known sostenuto pedal). Turning back to FIG. 2, the control portion 19 for controlling the electronic sound source 9 is an arithmetic logic circuit including known CPU 53, ROM 55 and RAM 56, and is connected via an input/output interface 57 to the electronic sound source 9, the key sensors 33 and 35, the pedal sensor (not shown) and other.

When the power switch 21 is turned on, the control portion 9 is driven with electric power transmitted from the power supply 18 outside the piano 1, moving and placing the rail 37 of the inhibition mechanism 13 into the operation inhibition position (refer to FIG. 3). At the same time, in response to signals transmitted from the key sensors 33, 35, the pedal sensor (not shown) and other, the performance information (data) is prepared and transmitted to the electronic sound source 9 for control.

The electronic power source 9 and the key sensors 33, 35 are also driven with electric power supplied from the power supply 18 when the power switch 21 is turned on.

A method of operating the above mentioned muffler pedal 16 and the power switch 21 in the upright piano 1 is now explained.

When sounds are produced from the electronic sound source 9 (the play is played as an electronic piano), the muffler pedal 16 in the condition shown in FIG. 5A (the muffler pedal 16 is at a stationary position without being stepped on) is stepped downward and slid toward the right indentation 49*b* as shown in FIG. 5B. The tip member 21*a* of the power switch 21 is depressed by the muffler pedal 16, turning on the power switch 21, and electric power is supplied to the electronic sound source 9, the control portion 19 and other. Therefore, the rail 37 of the inhibition mechanism 13 is moved to and secured in the operation inhibition position, such that the electronic sound source 9 can be controlled by the control portion 19. By playing the piano in the same manner as an acoustic piano, sounds are emanated from the electronic sound source 9 via a not shown headphone or loudspeaker (connected to the headphone terminal 11 and the loudspeaker terminal 12) and no string striking sound is made by the hammering mechanism 7.

As shown in FIG. 5C, even when the muffler pedal 16 is disengaged from the right indentation 49*b* after the power switch 21 is turned on, the power switch 21 remains on. Therefore, during the performance of the electronic sound source 9, the muffler pedal 16 can be operated as the sostenuto pedal.

Subsequently, when the performance of the electronic sound source 9 is ended and the power switch 21 is turned off, as shown in FIG. 5B, the muffler pedal 16 is again stepped on and slid toward the right indentation 49*b*, depressing the tip member 21*a* of the power switch 21. As shown in FIG. 5A, the muffler pedal 16 is returned to the stationary position. The power switch 21 is turned off, and the supply of electric power to the electronic sound source 9 and the control portion 19 is discontinued. The rail 37 is moved to and secured at the operation permission position (refer to FIG. 3), allowing the hammering mechanism 7 to operate. The piano can be played as an acoustic piano.

When the muffler pedal 16 is operated during the acoustic musical performance, as shown in FIG. 5D, the muffler pedal 16 is stepped on and engaged in the left indentation 49*a* in the front base 47, providing an original function of a sound softening pedal.

As aforementioned, in the upright piano 1 of the embodiment, the power switch 21 is provided for making and breaking the electrical connection between the power supply 18 and the control portion 19. By stepping on and sliding the muffler pedal 16 toward the right indentation 49*b*, the power switch 21 can be turned on or off. Thus, the power switch 21 is not provided on the surface of the upright piano 1 and the appearance of the piano is not impaired.

Also, when the original pedal effect (sound softening effect during acoustic performance or sostenuto effect during electronic piano performance) is obtained by stepping on the muffler pedal 16 during musical performance, the power switch 21 is not turned on or off until the muffler pedal 16 is shifted toward the right indentation 49*b*. Therefore, the performance is not interrupted by the power switch.

The embodiment has been explained. The invention is not restricted to the aforementioned embodiment, and can be practiced in various modes.

For example, the muffler pedal 16 can be replaced with the loud pedal 14 or the soft pedal 15 for turning on or off the power switch. For the loud pedal 14, as shown in FIG. 4, an indentation 73 (shown in a two-dot chain line) is formed in the right side of an opening 71 front base 47. In the same manner as the aforementioned embodiment, the power switch can be turned on or off, by stepping on and shifting the loud pedal 14 toward the indentation 73. In this structure, in the same manner as in the aforementioned embodiment, the power switch is not turned on or off even when stepping on the loud pedal 14 for the original pedal effect during the acoustic or electronic piano performance. The musical performance is not interrupted.

In the aforementioned embodiment, by stepping on and shifting the muffler pedal 16 toward the right indentation 49*b* (sidewards), the power switch is turned on or off. This is not limited to such pedal operation. For example, by pushing up the pedal from its stationary position (not stepped-on condition) or shifting sidewards the pedal, the power switch can be turned on or off.

Furthermore, any switch other than the power switch (for example, various mode changeover switches) can be turned on or off by the pedal.

Besides, in the inhibition mechanism 13 for stopping the sounding of the hammering mechanism 7, as shown in FIG. 3, the rail 37 for stopping the hammer shank 27 can be replaced by a rail 63 for stopping a catcher shank 61. For example, a sound stop mechanism described in Japanese patent application laid-open No. 63-216099 can be used, in which a hammer rail is rotated and a hammer is pushed against a string by a push means, and a hammer is retained by a lock means.

Also, the electronic sound source is not necessarily built in the piano. The electronic sound source (for example, MIDI sound source) can be mounted on the outside of the piano for control.

Of course, the invention can be applied to a grand piano with an electronic instrument built therein. The use in the grand piano is detailed in the patent application No. 5-214411 by the applicant of the present application or other.

A second embodiment of the invention is now explained based on the drawing figures.

Structures of the embodiment are first explained.

1. An upright piano, a grand piano or other acoustic piano is used, while an electronic piano or other electronic instrument with an electronic sound source is used.

2. For example, control quantity or sound volume (volume) to be controlled in an analog manner, tone changeover, and other are available.

3. For example, volume setting mode, tone setting mode and other set mode are expected.

4. As the condition of output to be controlled in the set mode, for example, a magnitude of sound volume in the volume set mode, selection from various kinds of tone in the tone set mode and other are listed.

5. As a pedal for changing the set mode, for example, a muffler pedal (or a sostenuto pedal) can be used, and can be set such that a specified mode is selected when the muffler pedal is stepped on or when the muffler pedal is stepped on a specified times. At the same time, when the specified mode is selected, sound volume can be set or tone can be selected dependent on the condition of other pedal like a loud pedal stepped on (the displacement and frequency of stepping of the pedal).

6. The momentum of the loud pedal, for example, is detected. The motion (especially, momentum) of the loud pedal is detected by a means having its light transmittance continuously varied relative to the direction of motion of the loud pedal, for example, a shutter. The shutter is composed of translucent filter and has its density gradually varied. The part of the shutter unable to let light pass has a triangular or moderately curved configuration or is finely dotted. The number, size or other of dots can be gradually varied.

As shown in FIG. 6, the upright piano 1 according to the second embodiment has a structure similar to that of the piano of the first embodiment, and is provided with the control portion 19 for controlling the electronic sound source 9 in response to operation of the keyboard 3 for musical performance.

The structure different from that of the first embodiment is now explained. The same components as those of the first embodiment are denoted with the same reference numerals.

A momentum sensor 146 is attached under the loud pedal 14 for detecting the momentum (stepped quantity) of the loud pedal 14. The momentum sensor 146 is, as shown in FIGS. 8A and B, composed of a shutter 147 attached to the underside of the key 5 and a photodetector 148 attached opposite to the shutter 147. The shutter 147 is a linear member consisting of translucent plastic and its lower part is darkened such that light transmittance is decreased toward the lower part. On the other hand, the photodetector 148 is composed of a light emitting diode 148*a* and a phototransistor 148*b* opposed to each other with the shutter 147 interposed therebetween. Therefore, as shown in FIGS. 8C and D, output voltage Vout of the phototransistor 148*b* varies with the position of the shutter 147. The position and momentum of the loud pedal 14 can be detected based on the output voltage Vout. Especially, in the second embodiment, the loud pedal 14 is adapted to function as a half pedal during performance of the electronic sound source 9. As detailed later, when a specific mode is selected by stepping on the muffler pedal 16, the loud pedal is used for setting sound volume and tone.

On the other hand, a selection switch 151 is, as shown in FIG. 7, provided under the muffler pedal 16 such that set mode is changed over to volume set mode or tone set mode by stepping on the muffler pedal 16. In the second embodiment, for example, by stepping on the muffler pedal 16 once, the volume set mode is set and by stepping the muffler pedal twice, the tone set mode is set.

Additionally, the control portion 19 is, as shown in FIG. 6, connected via the input/output interface 57 to a changeover switch 158 for selecting either performance of the hammering mechanism 7 or the electronic sound source 9, the momentum sensor 146 for the loud pedal 14, and a selection switch 151 for the muffler pedal 16.

In the control portion 19, when the performance of the hammering mechanism 7 is selected with the changeover switch 158, the rail 37 of the inhibition mechanism 13 is moved and secured to operation permission position (refer to FIG. 7) to produce string striking sounds. In this performance, the electronic sound source 9 is not controlled by the control portion 19. On the other hand, when the performance of the electronic piano by means of the electronic sound source 9 is selected with the changeover switch 158, the rail 37 of the inhibition mechanism 13 is moved and secured to operation inhibition position, permitting the control portion 19 to control the electronic sound source 9. Also, the control portion 19 prepares performance information (data) responsive to signal from the key sensors 33, 35, and transmits the performance information to the electronic sound source 9 for control. Furthermore, various modes are selected and the sound volume and tone in each mode are adjusted by stepping on the loud pedal 14 or the muffler pedal 16.

Operation of the upright piano 1 having the aforementioned structure in the second embodiment is now explained based on the flowchart of FIG. 9.

First, it is determined at step S100 whether or not the muffler pedal 16 for setting the mode is stepped on. If the answer to this step is affirmative, process advances to S110, and if the answer is negative, process advances to S120.

At S120, which is not a mode setting step, the normal function of a pedal in an electronic piano, for example, the function of a so-called half pedal of the loud pedal 14 is set (the function of electrically reducing the volume of sounds produced by the electronic sound source 9 responsive to the stepping on of the pedal), once ending the process.

On the other hand, the volume set mode is determined at S110 dependent on how many times the muffler pedal 16 is stepped on, for example, when the muffler pedal is stepped on once, and process goes to step S130, while the tone set mode is determined when the muffler pedal is stepped on twice, and process goes to step S160.

At step 130 output from the momentum sensor 146 of the loud pedal 14 is made correspondent to the volume switch. Subsequently, it is determined at step S140 whether or not the muffler pedal 16 is stepped on, while the loud pedal 14 is stepped on a specified quantity. If the answer to this step is negative, process returns to S100 and if the answer is affirmative, process advances to S150.

At S150 sound volume is set corresponding to the stepped-on quantity of the loud pedal 14 at the timing the muffler pedal 16 is stepped on, and process returns to S100.

As aforementioned, at steps S130–S150 sound volume can be set by operating a specified pedal and corresponding to the stepped-on quantity of the loud pedal 14. Instead of the step S140, for example, when the loud pedal 14 remains stationary at a certain position for a specified period of time (for example, 2 seconds), at step S150 sound volume can be set corresponding to the position of the loud pedal.

On the other hand, at S160 output from the momentum sensor 146 of the loud pedal 14 is made correspondent to the tone switch. Subsequently, it is determined at S170 whether or not the muffler pedal 16 is stepped on while the loud pedal 14 is stepped on a specified quantity. If the answer to this step is negative, process returns to S100, and if the answer is affirmative, process advances to S180.

At S180 tone is set corresponding to the stepped-on quantity of the loud pedal 14 at the timing the muffler pedal 16 is stepped on, and process returns to S100.

As aforementioned, at steps S160–S180 tone can be set by operating a specified pedal and corresponding to the stepped-on quantity of the loud pedal 14. Instead of the step S170, for example, when the loud pedal 14 remains stationary at a certain position for a specified period of time (for example, 2 seconds), at step S180 tone can be set corresponding to the position of the loud pedal. Instead of S160–S180, tone can be selected, for example, dependent on how many times the loud pedal 14 is stepped on.

As aforementioned, in the second embodiment, the loud pedal 14 and the muffler pedal 16 are used as the volume switch and the tone switch, respectively. Therefore, volume can be set and tone can be changed by operation of the pedal. Therefore, no holes for receiving switches or other are required in the surface or other of the piano, thereby not impairing the appearance of the piano advantageously.

The invention is not limited to the aforementioned embodiments and can be practiced in various modes in the range of the scope of the invention.

Although for example in the second embodiment, the loud pedal and the muffler pedal are used as the volume switch and the tone switch, a soft pedal can be additionally used.

Although further in the embodiment the shutter is attached to the side of the key, the photodetector can be attached to the key side. Although light transmittance is gradually reduced toward the tip of the shutter, the light transmittance can be set to increase toward the tip of the shutter.

INDUSTRIAL AVAILABILITY

As aforementioned, in the invention recited in claim 1, the performance of the electronic instrument can be changed over in response to operation of the pedal. Therefore, no switches are required on the surface of the piano, and the appearance of the piano is not impaired.

Also in the invention recited in claim 2, a power switch is provided for electrically connecting and disconnecting the control mechanism and the power source in response to operation of the pedal. For example by stepping on the pedal, power supply can be turned on or off. Therefore, no power switch is required on the surface of the piano and the appearance of the piano is advantageously prevented from being impaired.

Further in the invention recited in claim 3, by stepping on and shifting the pedal toward the indentation formed in the side of the opening of the front base, the power supply can be turned on or off. Accordingly, relatively simple stepping operation of the pedal enables power supply to turn on or off. Even if the original pedal effectiveness is obtained by stepping on the pedal during musical performance, the performance is advantageously prevented from being inhibited by turning on or off power supply.

In the invention recited in claim 4 the movement of the pedal is detected during performance of the electronic instrument with a piano incorporated therein. Corresponding to the detected movement of the pedal, the condition of the output to be controlled from the electronic instrument is adjusted. Thus, by stepping on the specified pedal during the performance of the electronic instrument, sound volume, for example, can be adjusted.

In the invention recited in claim 5, set mode is provided for each output to be controlled for setting the condition of various outputs to be controlled in the electronic instrument. During performance of the electronic instrument, set mode can be changed over to, for example, volume set mode, tone set mode or other, by means of a specified pedal.

In the invention recited in claim 6, when the specified mode is set by the mode changeover function of the pedal as recited in claim 5, the magnitude of sound volume, the type of tone or other condition of the output to be controlled can be set by means of other pedals.

Since as aforementioned, by operating the pedal, volume can be adjusted or tone can be changed, no holes for receiving switches are required on the surface or other of the piano. The appearance of the piano is advantageously prevented from being impaired.

I claim:

1. A piano with an electronic musical instrument built therein comprising:

a plurality of hammering mechanisms for striking a plurality of strings in response to operation of a keyboard;

at least one pedal for controlling string striking sound produced by said hammering mechanisms, an electronic musical instrument provided with an electronic sound source controlled according to the operation of said keyboard;

an inhibition means for inhibiting said hammering mechanisms from producing the string striking sound during the performance of said electronic musical instrument;

a changeover switch for changing between the performance mode of said electronic musical instrument and the performance mode of said hammering mechanisms, in response to one of a plurality of operations of said at least one pedal;

a movement condition detection means for detecting the movement of said at least one pedal when the performance mode of said electronic musical instrument is set by said changeover switch; and at least one electronic sound adjustment means for adjusting the electronic sound produced by said electronic musical instrument corresponding to the movement of said at least one pedal detected by said movement condition detection means.

2. A piano with an electronic musical instrument built therein according to claim 1, wherein said electronic sound adjustment means adjusts the volume of electronic sound corresponding to the movement amount of said at least one pedal.

3. A piano with an electronic musical instrument built therein according to claim 1, wherein said electronic sound adjustment means adjusts the tone of electronic sound corresponding to the movement amount of said at least one pedal.

4. A piano with an electronic musical instrument built therein according to claim 1 further comprising an indentation disposed in the side of an opening for passing through said pedal in a front base, whereby when said pedal is stepped on and slid toward said indentation, the performance mode is changed over from the performance mode of said electronic musical instrument and the performance mode of said hammering mechanisms.

5. A piano with an electronic musical instrument built therein according to claim 1 having a plurality of electronic sound adjustment means, further comprising a mode changeover means provided in a pedal function for switching between said plurality of electronic sound adjustment means.

6. A piano with an electronic musical instrument built therein according to claim 5, wherein a selected electronic sound adjustment means is controlled by an output control means provided in an additional pedal function.

7. A piano comprising:

an electronic sound source provided in an acoustic piano, using a keyboard in common for musical performance, the electronic sound source having at least one selectable electronic sound adjustment means for controlling at least one characteristic of sound to be outputted by the electronic sound source, and selection means, responsive to a first control input, for selecting between the sound adjustment means, wherein the first control input is provided in a pedal function for controlling said selection means, whereby when one of the electronic sound adjustment means is selected via the pedal function the electronic sound source is in a condition for modifying at least one sound output characteristic according to a second control input.

8. The piano of claim 7, wherein the second control input is provided in an additional pedal function.

* * * * *